US009407028B2

(12) United States Patent
Han et al.

(10) Patent No.: US 9,407,028 B2
(45) Date of Patent: Aug. 2, 2016

(54) ELECTRICAL CONNECTOR HOUSING HAVING A PROTRUSION WITH A RECESS TO ENGAGE A FASTENER

(71) Applicant: Tyco Electronics (Shanghai) Co. Ltd., Shanghai (CN)

(72) Inventors: Hongqiang Han, Shanghai (CN); WenYu Liu, Shanghai (CN); Youwei Pan, Shanghai (CN); Chenxi Wang, Shanghai (CN); Zhongwei Yu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/577,432

(22) Filed: Dec. 19, 2014

(65) Prior Publication Data

US 2015/0180168 A1 Jun. 25, 2015

(30) Foreign Application Priority Data

Dec. 20, 2013 (CN) ..... 2013 2 08485228 U
Sep. 5, 2014 (CN) ..... 2014 2 05120753 U

(51) Int. Cl.

| | |
|---|---|
| ***H01R 13/627*** | (2006.01) |
| ***H01R 13/506*** | (2006.01) |
| ***H01R 13/6581*** | (2011.01) |
| *H01R 13/533* | (2006.01) |

(52) U.S. Cl.

CPC ..... *H01R 13/506* (2013.01); *H01R 13/6273* (2013.01); *H01R 13/6581* (2013.01); *H01R 13/533* (2013.01)

(58) Field of Classification Search

CPC .. H01R 13/62; H01R 13/627; H01R 13/6271; H01R 13/6273

USPC ..... 439/352–355; 361/702–710

See application file for complete search history.

(56) References Cited

U.S. PATENT DOCUMENTS

| | | | | |
|---|---|---|---|---|
| 5,933,325 | A * | 8/1999 | Hou | H01L 23/4093 165/80.3 |
| 6,394,817 | B1 * | 5/2002 | Kihira | H01R 13/701 439/63 |
| 6,430,049 | B1 * | 8/2002 | Lai | H01L 23/4093 165/80.3 |
| 6,876,551 | B2 * | 4/2005 | Lee | H01L 23/4093 24/458 |
| 7,410,377 | B2 * | 8/2008 | Wharton | H01R 13/633 439/172 |
| 7,505,271 | B2 * | 3/2009 | Chen | H01L 23/4093 165/80.3 |
| 7,924,567 | B2 * | 4/2011 | Zha | H01L 23/4093 165/185 |

* cited by examiner

*Primary Examiner* — Chandrika Prasad
(74) *Attorney, Agent, or Firm* — Barley Snyder

(57) ABSTRACT

An electrical connector assembly is disclosed having a connector housing and a radiator securing member. The connector housing has at least one first protrusion formed with a locking tab receiving recess on a first stopping surface thereof. The radiator securing member has at least one first fastener engaged with the locking tab receiving recess of the first protrusion to connect the connector housing with the radiator securing member.

23 Claims, 8 Drawing Sheets

ELECTRICAL CONNECTOR HOUSING HAVING A PROTRUSION WITH A RECESS TO ENGAGE A FASTENER

CROSS-REFERENCE TO RELATED APPLICATION

This application claims priority under 35 U.S.C. §119(a)-(d) to Chinese Patent Application No. 201320848522.8, dated Dec. 20, 2014, and to Chinese Patent Application No. 201420512075.3, dated Sep. 5, 2014.

FIELD OF THE INVENTION

The present invention generally relates to an electrical connector, and more specifically, to an electrical connector assembly having a radiator.

BACKGROUND

During the operation of an electronic device, such as a high-speed electrical connector, generated heat often adversely affects the electrical performance of the electronic device. Conventionally, a radiator is mounted on a housing of the electronic device, so as to reduce the temperature of the electronic device by dissipating the generated heat. Often, the radiator is mounted on the connector housing through a fastening member, two ends of which are engaged to the connector housing in a hanging manner, so as to simplify the mounting operation. However, since the fastening member is engaged to the connector housing in a hanging manner, the radiator may be readily separated from the connector housing due to vibrational forces. Consequently, upon separation, the efficiency of heat dissipation is greatly reduced.

There is a need for an electrical connector assembly having a radiator connected to a connector housing, that is resistant to vibrational forces.

SUMMARY

An electrical connector assembly having a connector housing and a radiator securing member. The connector housing has at least one first protrusion formed with a locking tab receiving recess on a first stopping surface thereof. The radiator securing member has at least one first fastener engaged with the locking tab receiving recess of the first protrusion to connect the connector housing with the radiator securing member.

BRIEF DESCRIPTION OF THE DRAWINGS

The invention will now be described by way of example, with reference to the accompanying Figures, of which.

DETAILED DESCRIPTION OF THE PREFERRED EMBODIMENTS

Figure 1:
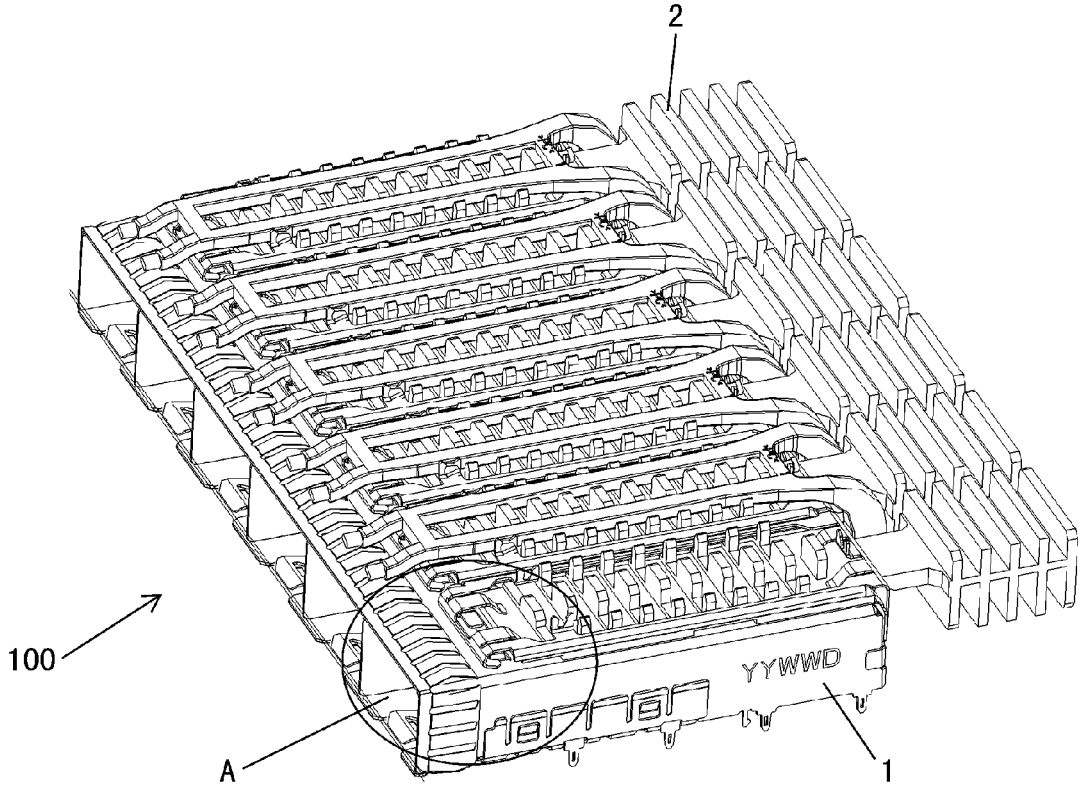
FIG. 1 is a perspective view of an electrical connector assembly.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those of ordinary skill in the art.

Further, in the following detailed description, for purposes of explanation, numerous specific details are set forth in order to provide a thorough understanding of the disclosed embodiments. One of ordinary skill in the art would appreciate that one or more embodiments may be practiced without these specific details. Further, well-known structures and devices are schematically shown in order to simplify the drawing.

Figure 2:
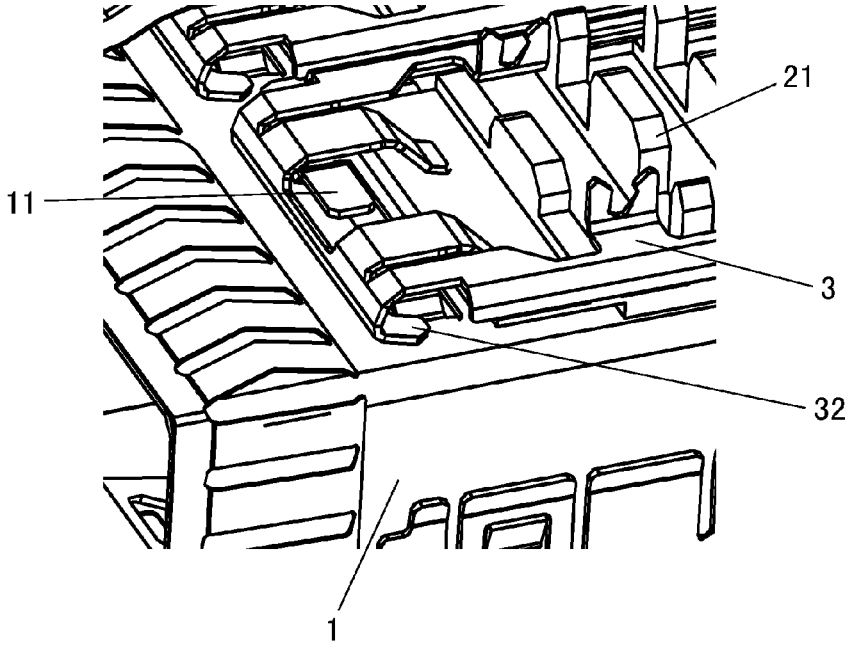
FIG. 2 is an enlarged view of portion A in FIG. 1.

In the embodiments of FIGS. 1 and 2, an electrical connector assembly 100 includes: a connector housing 1 and a radiator securing member 3. The connector housing 1 may be formed from stainless steel material or hard plastic material.

Figure 4:
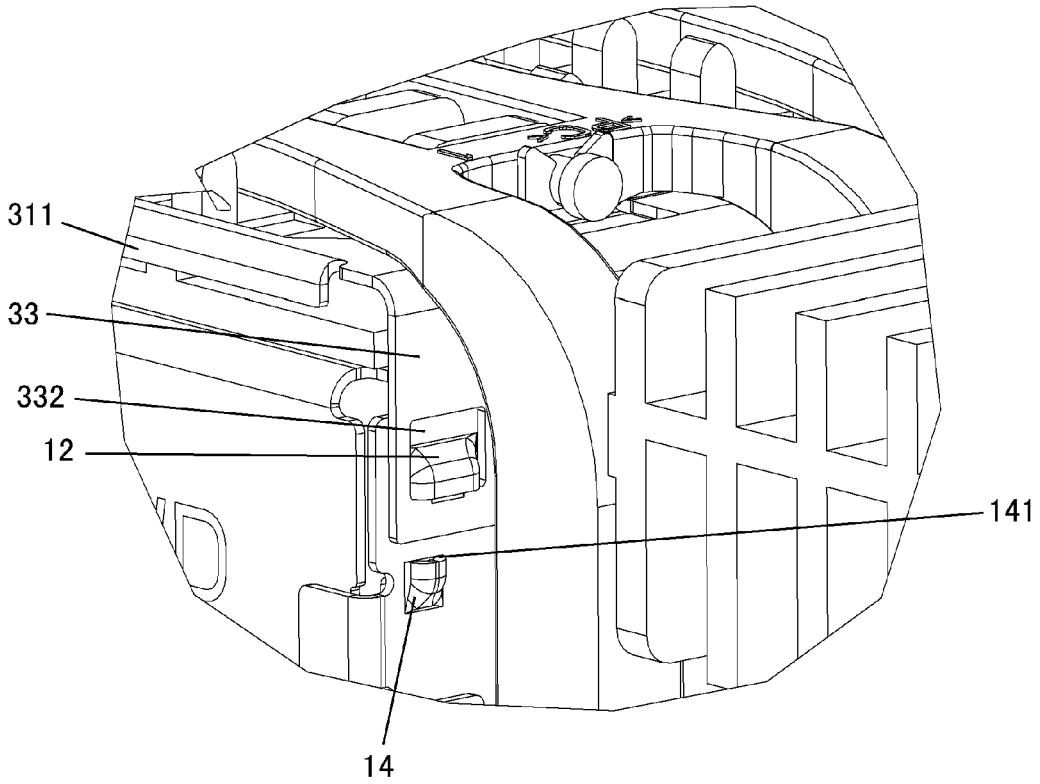
FIG. 4 is an enlarged view of portion B in FIG. 3.
Figure 7:
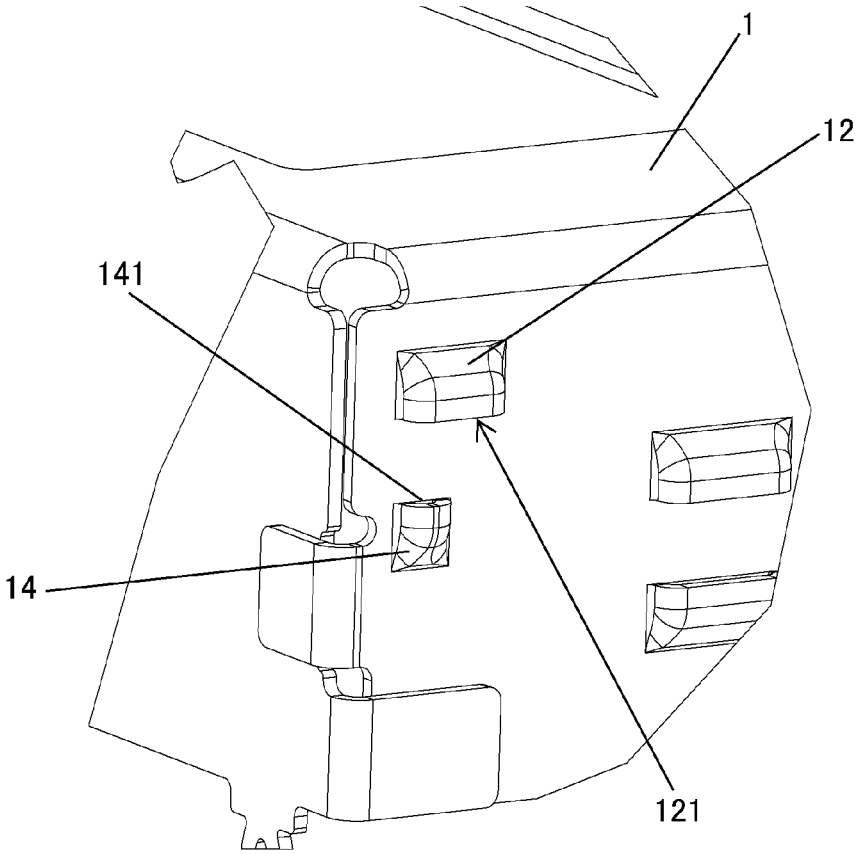
FIG. 7 is an enlarged view of portion D in FIG. 5.
Figure 8:
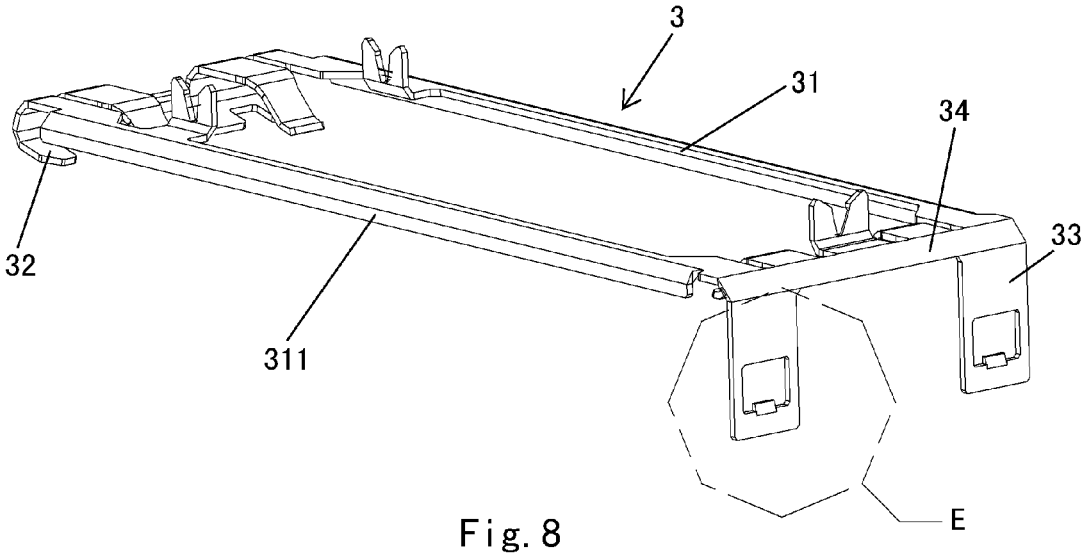
FIG. 8 is a perspective view of a radiator securing member.
Figure 9:
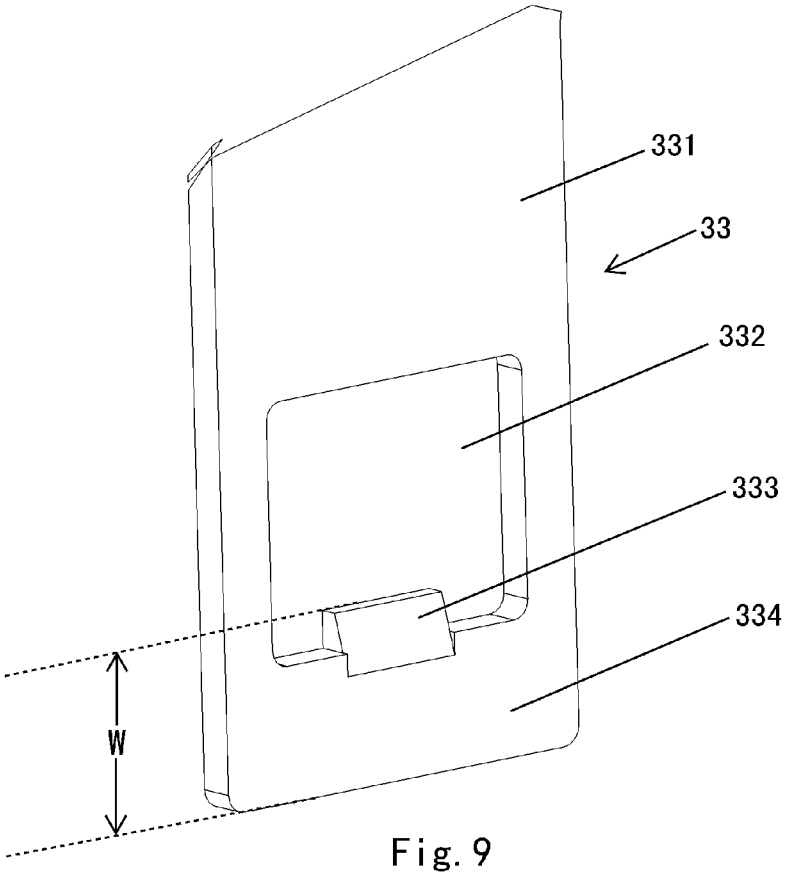
FIG. 9 is an enlarged view of portion E in FIG. 8.

In the embodiments of FIGS. 4 and 7, the connector housing 1 has at least one first protrusion 12 formed with a first stopping surface on which a locking tab receiving recess 121 is formed. In the embodiments of FIGS. 8 and 9, the radiator securing member 3 has at least one first fastener 33 with a protrusion, which engages the first stopping surface of a corresponding first protrusion 12 to connect the connector housing 1 to the radiator securing member 3. In this way, the locking tab receiving recess 121 of the first protrusion 12 is engaged with the first fastener 33 to prevent the first fastener 33 from being separated from the first protrusion 12. Therefore, the first fastener 33 is securely connected to the first protrusion 12 of the connector housing 1, and the reliable connection between the connector housing 1 and the radiator securing member 3 is established.

In an embodiment, the connector housing 1 includes a second protrusion 14 positioned a distance from the first protrusion 12 on the same side of the connector housing 1. When the radiator securing member 3 is connected to the connector housing 1, a portion of the first fastener 33 is positioned between the first protrusion 12 and the second protrusion 14. The second protrusion 14 has a second stopping surface 141 facing the first stopping surface, and being positioned to prevent the first fastener 33 from being separated from the locking tab receiving recess 121.

In the embodiments of FIGS. 4 and 7-9, the first fastener 33 has a locking tab 333, which may be inserted into the locking tab receiving recess 121, with the second stopping surface 141 being positioned so as to prevent the locking tab 333 from being separated from the locking tab receiving recess 121. In this way, the first fastener 33 is securely connected to the first protrusion 12 of the connector housing 1, and a reliable connection between the connector housing 1 and the radiator securing member 3 is established.

In the embodiments of FIGS. 1 and 2, the connector housing 1 forms a housing of an electronic device.

In an embodiment, the electrical connector assembly 100 includes a radiator 2 positioned on an outside of the connector housing 1. The radiator securing member 3 connects the radiator 2 to the connector housing 1.

In an embodiment, the connector housing 1 includes a plurality of first fixtures 11. In an embodiment of FIG. 8, the radiator securing member 3 further comprises at least one securing member body 31, the first fastener 33 being positioned at a first end of the securing member body 31 when the radiator securing member 3 is engaged with the connector housing 1; and at least one second fastener 32 positioned on a second end of the securing member body 31, opposite to the first fastener 33 and engaged to the corresponding first fixture 11. In an embodiment, the radiator securing member 3 has two securing member bodies 31 extending approximately parallel from a front side end proximate to a second fastener 32 to a rear side end proximate to the first fastener 33. One portion of each radiator 2 is engaged to the connector housing 1 between the second fastener 32 and the first fastener 33. In this way, unless the locking tab 333 is disengaged from the locking tab receiving recess 121, the first fastener 33 cannot be separated from the first protrusion 12. Thus, the first fastener 33 and the first protrusion 12 are securely engaged with each other in locking manner.

Figure 5:
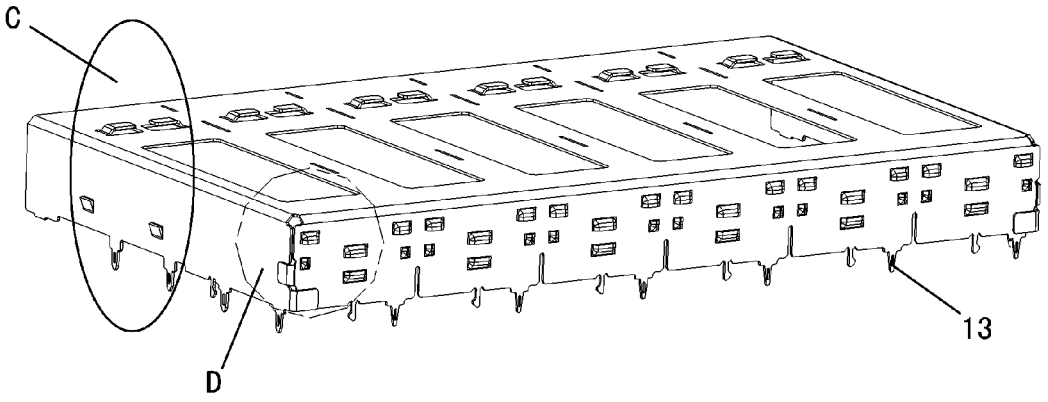
FIG. 5 is a perspective view a housing of the connector assembly.

In the embodiments of FIGS. 1 and 5, when the electronic device is an electrical connector, the connector housing 1 has a substantially cuboid shape, with a plurality of mating connector receiving spaces positioned on a front side for receiving a mating electrical connector, and a housing base thereof includes a plurality of pins 13 mounted to a mounting apparatus, such as a circuit board.

In an embodiment of FIGS. 1 and 2, an electrical connector assembly 100 includes the first fixture 11 positioned on a upper surface of the connector housing 1, for example, at a position proximate to the front side end of the upper surface of the connector housing 1.

In an embodiment of FIG. 4, the first protrusion 12 is positioned on a side surface of the connector housing 1, for example, at the rear side surface opposite to the front side surface. The radiator 2 is firstly placed on the upper surface of the connector housing 1. The radiator 2 is then secured to the upper surface of the connector housing 1 by the securing member body 31 of the radiator securing member 3, where the second fastener 32 engages the first fixture 11. The second fastener 32 is formed by bending a portion of the securing member body 31 towards the connector housing 1 to form, for example, a barb-like shape.

Figure 6:
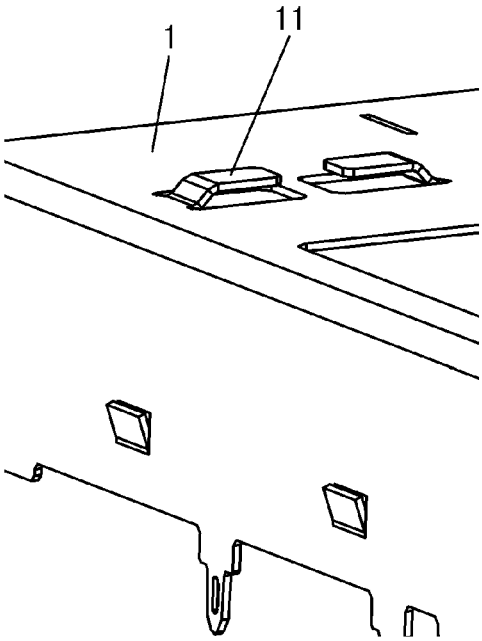
FIG. 6 is an enlarged view of portion C in FIG. 5.

In the embodiments of FIGS. 2 and 6, the first fixture 11 is elastically deformable, and protrudes outward from the upper surface of the connector housing 1. The second fastener 32 is connected to the elastic first fixture 11, such that the first fixture 11 is securely connected to the second fastener 32 of the radiator securing member 3.

In an embodiment, the first fixture 11 may be an opening formed on the upper surface of the connector housing 1, and the second fastener 32, as shown in the embodiment of FIG. 8, may be directly positioned in the first fixture 11 opening. In another embodiment, the second fastener 32 engages an edge of the first fixture 11 opening, which is positioned on the upper surface of the connector housing 1, proximate to the front side.

Figure 3:
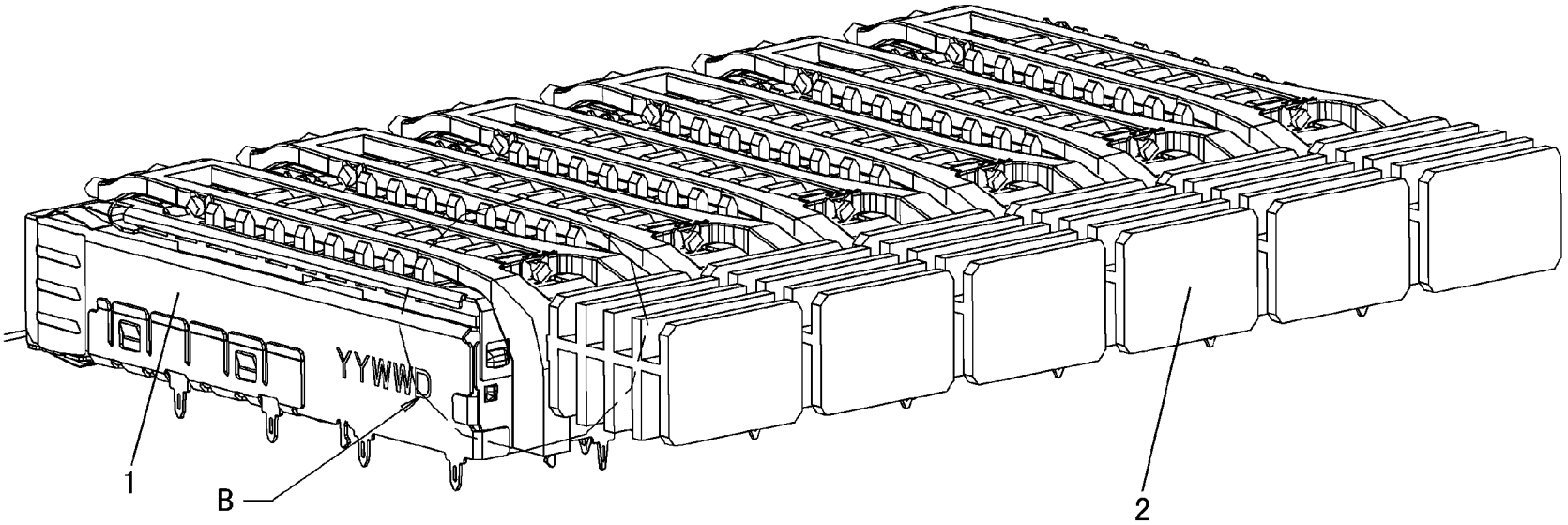
FIG. 3 is a perspective view of a rear side of the connector assembly of FIG. 1.

In an embodiment of FIG. 7, the first protrusion 12 extends outward from the rear side surface of the connector housing 1, and includes the locking tab receiving recess 121 facing away from the upper surface of the connector housing 1. In the embodiments of FIGS. 3, 8 and 9, the first fastener 33 of the radiator securing member 3 extends downwards perpendicular to the securing member body 31 along, for example, the rear side surface of the connector housing 1. The first fastener 33 further includes a locking tab 333, which may be inserted into the locking tab receiving recess 121.

In an embodiment, the first fastener 33 includes a substantially flat portion 331 orthogonally extending from the rear facing end of the securing member body 31, a projection receiving opening 332 is formed on the flat portion 331 and having a substantially rectangle shape with closed periphery, and a terminating end portion 334 extending from the projection receiving opening 332. The locking tab 333 is positioned on a flat portion facing edge of the terminating end portion 334, and extends into the projection receiving opening 332.

The distance between the first stopping surface and the second stopping surface 141 is less than a total width W of the terminating end portion 334. The total width W comprises the width of the terminating end portion 334 plus a length by which the locking tab 333 extends into the projection receiving opening 332 from the edge of the terminating end portion 334. In this way, the second stopping surface 141 of the second protrusion 14 may prevent the locking tab 333 from being disengaged from the locking tab receiving recess 121 of the first protrusion 12. When the first fastener 33 is engaged to the first protrusion 12, the first fastener 33 may slightly deform so as to engage the locking tab 333 to the locking tab receiving recess 121 in snap-fitting manner.

In an embodiment, the terminating end portion 334 is a notch formed on the substantially flat portion 331 of the first fastener 33 and recessed inwards from one side of the flat portion 331.

In an embodiment of FIG. 8, the securing member body 31 includes elastic flanges 311 extending towards the upper surface of the connector housing 1 when the securing member body 31 is connected to the connector housing 1. In this way, when the radiator 2 is mounted on the connector housing 1 by the radiator securing member 3, the securing member body 31 may produce an elastic force so as to tightly hold the radiator 2 on the connector housing 1. Furthermore, the radiator securing member 3 also includes a securing member connecting arm 34 connected to the rear side ends of two parallel securing member bodies 31, and a securing member connecting arm 34 connected to the front side ends of the two parallel securing member bodies 31.

In the embodiment of FIG. 2, a plurality of fins 21 of the radiator 2 are positioned between the two securing member bodies 31. As shown in FIG. 8, a substantially rectangle frame with a central radiator fin receiving opening is formed between the two adjacent securing member bodies 31 and two securing member connecting arms 34. One of ordinary skill in the art would understand that the radiator securing member 3 may be constructed as the rectangle frame with one opening, as shown in the embodiment of FIG. 8, or may be constructed as the rectangle frame with a plurality of openings, or may be constructed as a strip-type structure only including one securing member body 31, one second fastener 32 and one first fastener 33.

To mount the radiator 2 on the connector housing 1, firstly, the radiator 2 is positioned on the upper surface of the connector housing 1. Next, the second fastener 32 of the radiator securing member 3 engages the elastic portion of the first fixture 11 of the connector housing 1. The securing member bodies 31 of the radiator securing member 3 extend over a edge portions of the radiator 2, and the flat portion 331 of the first fastener 33 is positioned along the rear side surface of the connector housing 1. The securing member body 31 of the radiator securing member 3 is then pressed downward towards the connector housing 1, such that the projection receiving opening 332 and the locking tab 333 of the first fastener 33 pass over the first protrusion 12.

In the embodiment of FIG. 4, the locking tab 333 slightly deforms as it passes over the first protrusion 12. The locking tab 333 is then received into the locking tab receiving recess 121 of the first protrusion 12 in the snap-fitting manner, due to the elastic force of the elastic flanges 311 of the securing member bodies 31. Since the predetermined distance between the first stopping surface and the second stopping surface 141 is slightly less than the total width W of the terminating end portion 334, the locking tab 333 will not disengage from the locking tab receiving recess 121. In this way, even in the presence of vibrational forces, the first fastener 33 will remain connected to the first protrusion 12. Consequently, the radiator 2 is reliably fixed and connected to the connector housing 1 of the electronic device, ensuring the heat dissipation efficiency of the radiator 2.

To remove a fixed radiator 2 from the connector housing 1, the securing member body 31 of the radiator securing member 3 first is pressed downward towards the connector housing 1. The securing member body 31 elastically bends downward at the location where it is pressed, with the rear and front end sides consequently being deflected upward. As the rear side end of the radiator securing member 3 deflects upward, the locking tab 333 disengages from the locking tab receiving recess 121 as the flat portion 331 of the first fastener 33 moves away from the rear side surface of the connector housing 1. The first fastener 33 is therefore disengaged from the first protrusion 12, thus detaching the radiator securing member 3 from the connector housing 1. The radiator 2 can subsequently be removed.

In the embodiments of FIGS. 10-13, a connection between a first fastener 33' and the first protrusion 12 are shown. Components in FIGS. 10-13 which are the same as those of FIGS. 4 and 7-9 are indicated by the same reference number. Hereinafter, only the structures different from FIGS. 4 and 7-9 will be described in reference to FIGS. 10-13. Referring to FIGS. 10-13, the locking tab receiving recess 121 of the first protrusion 12 includes a stopping portion 122 extending perpendicular to the first stopping surface of the first protrusion 12, from a top portion of the first stopping surface to the first fastener 33'.

The first fastener 33' includes the substantially flat portion 331 and the projection receiving opening 332 formed on the flat portion 331. The first protrusion 12 is inserted through the projection receiving opening 332 and the first stopping surface of the first protrusion 12 abuts a lower side edge of the projection receiving opening 332. A terminating end portion 334' extends from the flat portion 331, from the lower side edge of the projection receiving opening 332. The stopping portion 122 extending over the upper portion of the terminating end portion 334' so as to prevent the terminating end portion 334' from being separated from the stopping portion 122 of the first protrusion 12, thereby securely engaging the first fastener 33' and the first protrusion 12.

In an embodiment, the connector housing 1 includes the second protrusion 14, wherein, the terminating end portion 334' of the first fastener 33 is positioned between the first protrusion 12 and the second protrusion 14. The second protrusion 14 includes a second stopping surface 141 facing the first stopping surface 121 to prevent the terminating end portion 334' from being separated from the stopping portion 122. In an embodiment, a predetermined distance between the end of the stopping portion 122 and the second stopping surface 141 is slightly smaller than the width of the terminating end portion 334' (see width W in the embodiment of FIG. 9. In this way, the second stopping surface 141 of the second protrusion 14 may reliably prevent the terminating end portion 334' from becoming separated from the stopping portion 122. When the first fastener 33' is engaged to the first protrusion 12, the terminating end portion 334' of the first fastener 33' and/or the stopping portion 122 may slightly deform, such that the terminating end portion 334' is engaged to the lower portion of stopping portion 122 in a snap-fit manner.

To mount the radiator 2 to the connector housing 1, firstly, the radiator 2 is positioned on the upper surface of the connector housing 1. Next, the second fastener 32 of the radiator securing member 3 engages the elastic portion the first fixture 11 of the connector housing 1. The securing member bodies 31 of the radiator securing member 3 extend over edge portions of the radiator 2, and the flat portion 331 of the first fastener 33' is positioned along the rear side surface of the connector housing 1. The securing member body 31 of the radiator securing member 3 is then pressed downward towards the connector housing 1, such that the projection receiving opening 332 and the terminating end portion 334' of the first fastener 33' pass over the first protrusion 12.

Figure 10:
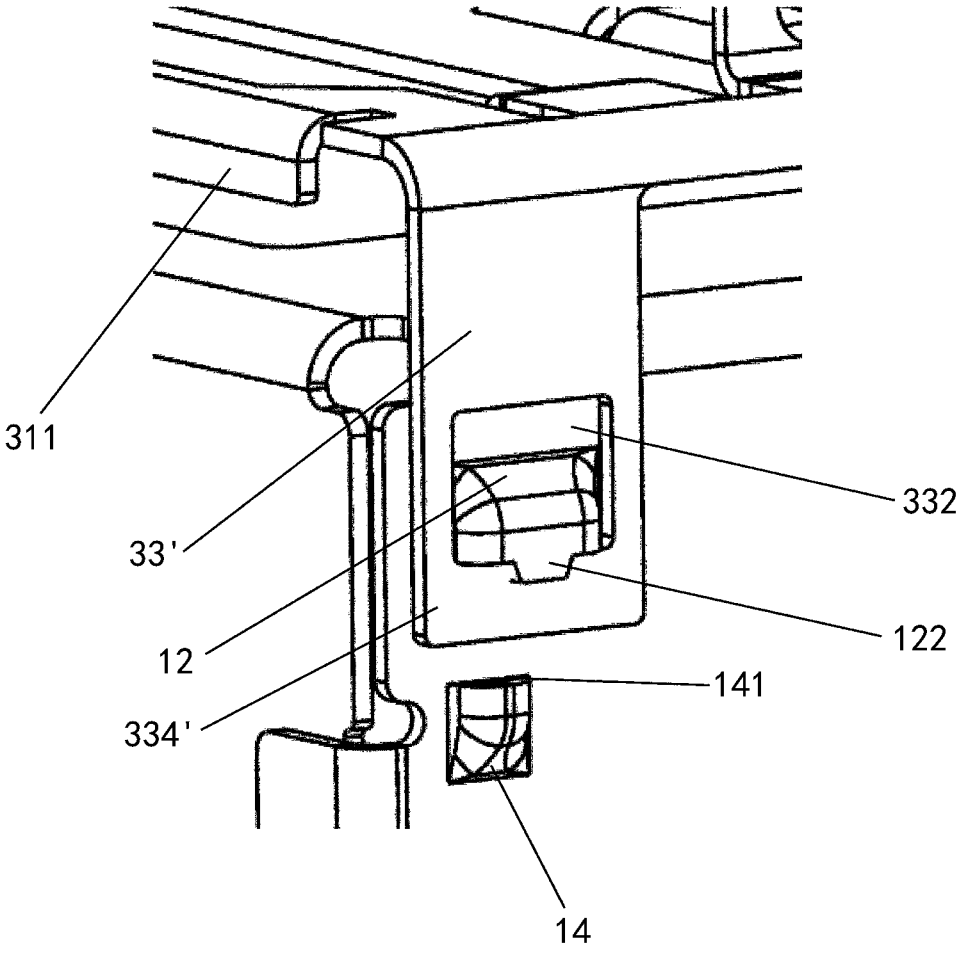
FIG. 10 is an enlarged view of portion B in FIG. 3, without the radiator.
Figure 11:
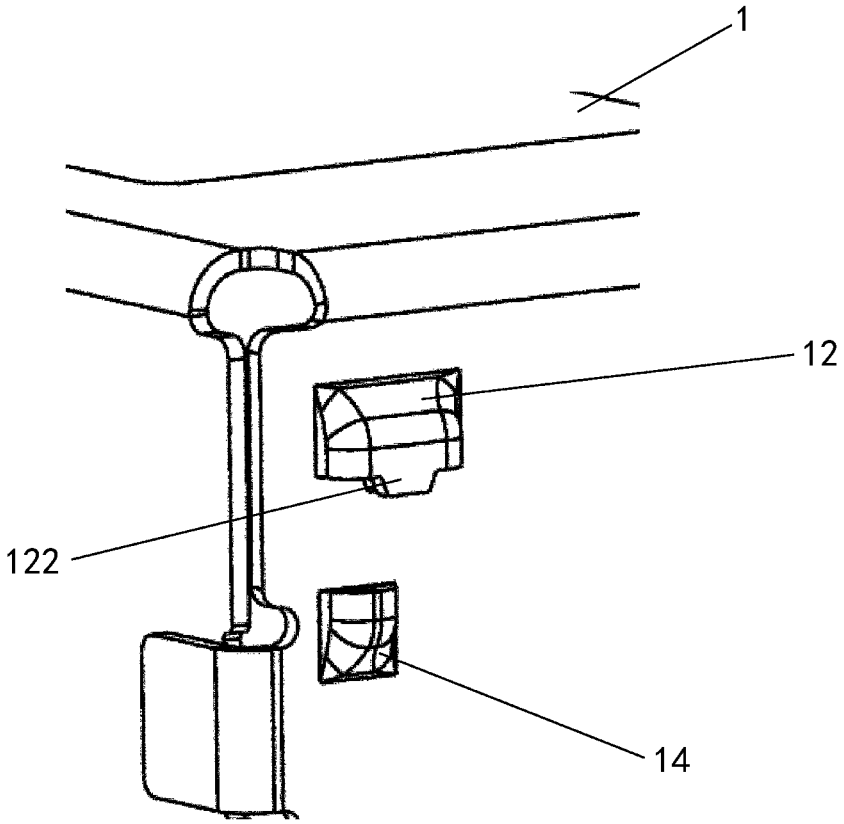
FIG. 11 is an enlarged view of portion D in FIG. 5.
Figure 12:
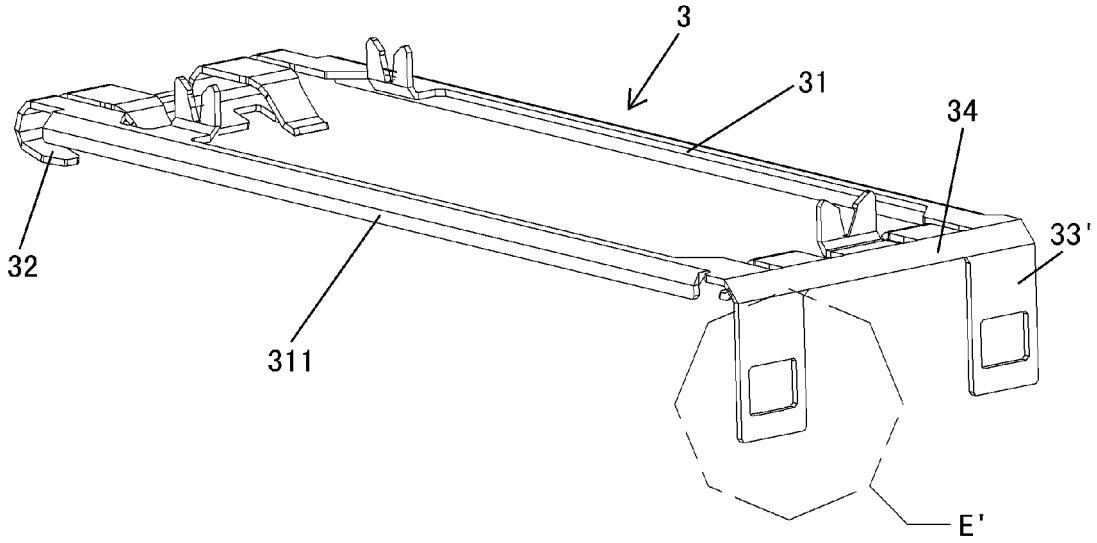
FIG. 12 is a perspective view of a radiator securing member.
Figure 13:
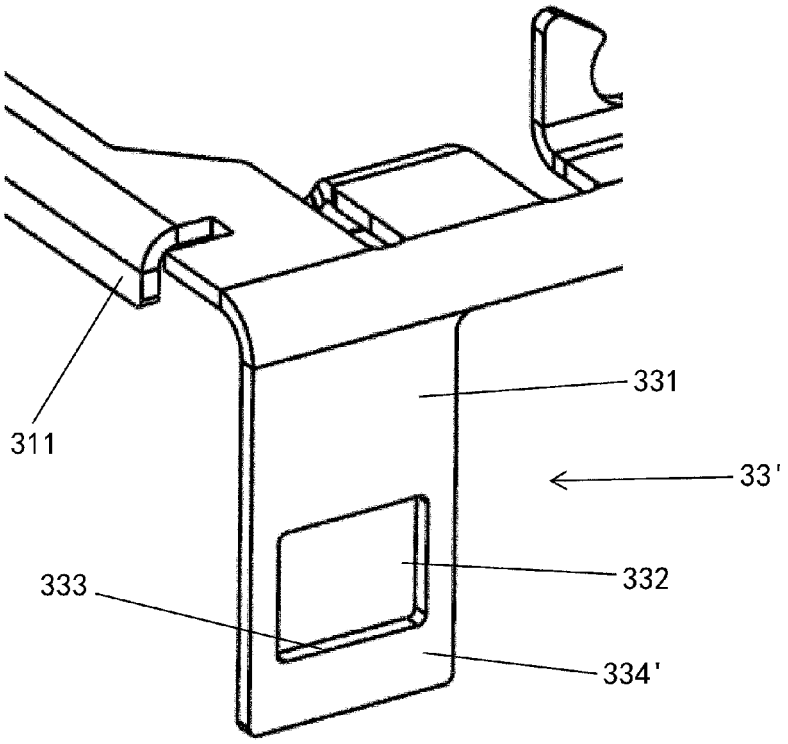
FIG. 13 is an enlarged view of portion E' in FIG. 12.

In an embodiment of FIG. 10, the terminating end portion 334', as well as the stopping portion 122, slightly deform as they pass over the first protrusion 12. The first protrusion 12 then rests against the lower portion of the stopping portion 122, and the radiator securing member 3 is accordingly secured to the connector housing 1 in the snap-fitting manner due to the elastic force exerted by the elastic flanges 331. Since the predetermined distance between the end of the stopping portion 122 and the second stopping surface 141 is slightly less than the total width W of the terminating end portion 334', the terminating end portion 334' will not disengage from the stopping portion 122. In this way, even in the presence of vibrational forces, the first fastener 33' will remain connected to the first protrusion 12. Consequently, the radiator 2 is reliably fixed and connected on the connector housing 1 of the electronic device, ensuring the heat dissipation efficiency of the radiator 2.

To remove a fixed radiator 2 from the connector housing, the securing member body 31 of the radiator securing member 3 is first pressed downwards toward the connector housing 1. The securing member body 31 elastically bends downward at the location where it is pressed, with the rear and front end sides consequently being deflected upward. As the rear side end of the radiator securing member 3 deflects upward, the terminating end portion 334' disengages from the stopping portion 122 as the flat portion 331 of the first fastener 33' is displaced away from the rear side surface of the connector housing 1. The first fastener 33' is therefore disengaged from the first protrusion 12, thus detaching the radiator securing member 3 from the connector housing 1. The radiator 2 can subsequently be removed.

Although the above described embodiments disclose an electric connector as an electronic device, one of ordinary skill in the art would appreciate that the electronic device may be any kind of device generating heat, such as a photoelectric transducer, a reader for reading a memory device, an electronic assembly for packaging electronic components, such as CPU, amplifier, and the like.

It should be appreciated for those of ordinary skill in this art that the above embodiments are intended to be illustrated, and not restrictive. For example, many modifications may be made to the above embodiments by those skilled in this art, and various features described in different embodiments may be freely combined with each other without conflicting in configuration or principle, so as to implement many kinds of connector assemblies on the basis of solving the technical problems of the present invention.

Further, one of ordinary skill in the art can readily understand that various changes or modifications may be made in these embodiments without departing from the principles and spirit of the disclosure, the scope of which is defined in the attached claims and their equivalents. The present invention is not limited to the exemplary embodiments set forth in the description.

What is claimed is:

1. An electrical connector assembly, comprising:

a connector housing having at least one first protrusion extending outward therefrom, the first protrusion having a locking tab receiving recess; and a radiator securing member having at least one first fastener engaged with the locking tab receiving recess of the first protrusion to connect the connector housing with the radiator securing member.

2. The electrical connector assembly of claim 1, wherein the connector housing further comprises a second protrusion having a stopping surface positioned towards the locking tab receiving recess.

3. The electrical connector assembly of claim 2, wherein a portion of the first fastener is positioned between the locking tab receiving recess and the second protrusion.

4. The electrical connector assembly of claim 2, wherein the first fastener has a locking tab that is received in the locking tab receiving recess when the first fastener is engaged with the first protrusion.

5. The electrical connector assembly of claim 4, wherein the stopping surface prevents the locking tab from being separated from the locking tab receiving recess.

6. The electrical connector assembly of claim 4, wherein the first fastener further comprises a substantially flat portion;

a projection receiving opening formed on the flat portion;

a terminating end portion extending from the projection receiving opening; and the locking tab positioned on a flat portion facing edge of the terminating end portion and extending into the projection receiving opening.

7. The electrical connector assembly of claim 6, wherein a distance between the locking tab receiving recess and the stopping surface is less than a total width of the terminating end portion.

8. The electrical connector assembly of claim 2, further comprising a stopping portion extending perpendicular from the locking tab receiving recess.

9. The electrical connector assembly of claim 8, wherein, the first fastener further comprises a substantially flat portion;

a projection receiving opening formed on the flat portion, the first protrusion being received in the projection receiving opening and the locking tab receiving recess abutting on a lower side wall of the projection receiving opening when the connector housing is connected to the radiator securing member; and a terminating end portion extending from the projection receiving opening, the first protrusion being positioned over an upper portion of the terminating end portion when the first protrusion is received in the projection receiving opening.

10. The electrical connector assembly of claim 9, wherein a distance between the locking tab receiving recess and the stopping surface is less than a total width of the terminating end portion.

11. The electrical connector assembly of claim 1, wherein the connector housing is a housing.

12. The electrical connector assembly of claim 1, further comprising a radiator connected to the connector housing by the radiator securing member.

13. The electrical connector assembly of claim 12, wherein the radiator securing member further comprises a plurality of first fasteners;

at least one securing member body having the first fastener positioned on a first end thereof; and at least one second fastener positioned on a second end of the securing member body, opposite to the first fastener, and engaged to a corresponding first fixture positioned on the connector housing.

14. The electrical connector assembly of claim 13, wherein a portion of the radiator is positioned on the connector housing between the second fastener and the first fastener.

15. The electrical connector assembly of claim 14, wherein the first fixture is positioned on an upper surface of the connector housing.

16. The electrical connector assembly of claim 15, wherein the first protrusion is positioned on a side surface of the connector housing.

17. The electrical connector assembly of claim 16, wherein a portion of the radiator is fixed on the upper surface of the connector housing by the securing member body.

18. The electrical connector assembly of claim 17, wherein the second fastener engages the first fixture when the radiator securing member is connected to the connector housing.

19. The electrical connector assembly of claim 13, wherein the second fastener extends away from the securing member body towards the upper surface of the connector housing.

20. The electrical connector assembly of claim 13, wherein the first fixture is an elastically deformable, protruding outward from the upper surface of the connector housing, and engages the second fastener.

21. The electrical connector assembly of claim 13, wherein the radiator securing member includes a securing member connecting arm connected to the second end of two parallel securing member bodies.

22. The electrical connector assembly of claim 21, wherein a plurality of radiator fins are positioned between the parallel securing member bodies when the radiator is fixed to the connector housing.

23. The electrical connector assembly of claim 13, wherein the electronic device is an electrical connector.

* * * * *